US007328635B2

(12) United States Patent
Hu

(10) Patent No.: US 7,328,635 B2
(45) **Date of Patent: *Feb. 12, 2008**

(54) SCREWDRIVER HANDLE

(76) Inventor: Bobby Hu, 8F, No.536-1, Ta Chin Street, Taichung (TW)

( * ) Notice: Subject to any disclaimer, the term of this patent is extended or adjusted under 35 U.S.C. 154(b) by 0 days.

This patent is subject to a terminal disclaimer.

(21) Appl. No.: 11/551,357

(22) Filed: Oct. 20, 2006

(65) Prior Publication Data

US 2007/0107563 A1 May 17, 2007

(30) Foreign Application Priority Data

Nov. 11, 2005 (TW) ..... 94139634 A
Oct. 5, 2006 (TW) ..... 95137210 A

(51) Int. Cl.
*B25B 23/16* (2006.01)

(52) U.S. Cl. ..... 81/177.9; 81/177.7; 81/177.85

(58) Field of Classification Search ..... 81/177.1, 81/177.8, 177.9, 177.7, 177.4, 177.85; 403/160
See application file for complete search history.

(56) References Cited

U.S. PATENT DOCUMENTS 4,759,240 A * 7/1988 Lin ..... 81/177.8
4,825,734 A * 5/1989 Schwalbe et al. ..... 81/177.9
2001/0052275 A1* 12/2001 Liao ..... 81/177.7

* cited by examiner

*Primary Examiner*—Jacob K. Ackun, Jr.
(74) *Attorney, Agent, or Firm*—Alan Kamrath; Kamrath & Associates PA

(57) ABSTRACT

A screwdriver handle includes a first handle part and a second handle part. A first pivotal coupling portion is formed on an end face of the first handle part and includes two receptacles each receiving a positioning member. The second handle part includes an end face with a second pivotal coupling portion pivotally engaged with the first pivotal coupling portion. A positioning hole extends from a wall of the second pivotal coupling portion. One of the positioning members is biased into a retaining section of the positioning hole to position the second handle part. A control member is mounted in the positioning hole and movable to urge the positioning member in the receptacle aligned with the positioning hole into the receptacle, allowing the screwdriver handle to be switchable between an in-line state and an angled-state.

14 Claims, 12 Drawing Sheets

3 - 3

SCREWDRIVER HANDLE

BACKGROUND OF THE INVENTION

1. Field of the Invention

The present invention relates to a screwdriver handle that can be retained in an in-line state or an angled state.

2. Description of the Related Art

FIGS. 1 through 4 of the accompanying drawings illustrate a conventional screwdriver handle 90 comprising a front handle part 91 and a rear handle part 92. In a first position, the longitudinal axes of the handle parts are substantially coincident with each other and in a second position, the longitudinal axes of the handle parts are at an angle relative to each other. The front handle part 91 includes a slanted circular rear end face 911. A pivotal member 912 is mounted to the rear end face 911 and includes a protrusion 913. A push button 914 and a spring 915 are mounted in a compartment (not labeled) in a side of the pivotal member 912, with an end of the push button 914 extending out of the front handle part 91 for manual operation via a through-hole (not labeled) in the first handle part 91. The rear handle part 92 includes a slanted circular front end face 921 in which a groove 922 is defined for pivotally receiving the pivotal member 912. A through-hole 923 extends from a bottom wall defining the groove 922 through an outer periphery of the rear handle part 92. A C-clip (not labeled) is mounted in the through-hole 923 for retaining the protrusion 913 in the through-hole 923 while allowing pivotal movement of the pivotal member 912. A plug 924 is provided to seal the through-hole 923. Three positioning holes 925 are defined in a circumferential wall defining the groove 922, and the other end of the push button 914 is selectively engaged in one of the positioning holes 925 for retaining the front handle part 91 in place.

However, in addition to the through-hole in the front handle part 91, it is necessary to drill another hole (i.e., the through-hole 923) in the second handle part 20 and to provide a plug 924 for sealing the through-hole 923 required for mounting the C-clip onto the protrusion 913, which is time-consuming and costly. Further, the plug 924 is apt to fall out of the through-hole 923 during operation, leading to accumulation of dust and dirt in the through-hole 923 that may cause adverse effect to pivotal movement and/or positioning effect of the front handle part 91.

Further, when using the screwdriver handle 90 to drive, e.g., a screw, a forward force against the screw is applied while rotating the screwdriver handle 90. The push button 914 is liable to be inadvertently pressed while applying the forward force and the rotational force, leading to a risk of undesired pivotal movement between the front handle part 91 and the rear handle part 92. As a result, inconvenience of use and injury to the user are likely to occur.

SUMMARY OF THE INVENTION

A screwdriver handle in accordance with the present invention comprises a first handle part and a second handle part. The first handle part includes an end face on which a first pivotal coupling portion is formed. The second handle part includes an end face pivotally connected to the end face of the first handle part. The end face of the second handle part includes a second pivotal coupling portion for pivotally engaging with the first pivotal coupling portion of the first handle part. The second handle part is pivotable between a first position and a second position relative to the first handle part such that the screwdriver handle is switchable between an in-line state and an angled state.

Two receptacles are defined in the first pivotal coupling portion. Two positioning members are respectively received in the receptacles. Two elastic elements are respectively mounted in the receptacles for respectively biasing the positioning members outward. A positioning hole extends from a wall of the second pivotal coupling portion through an outer periphery of the second handle part. The positioning hole includes a retaining section aligned with one of the receptacles.

One of the positioning members is biased by an associated one of the elastic elements into the retaining section of the positioning hole to retain the second handle part in one of the first position and the second position. A control member is mounted in the positioning hole and movable to urge the positioning member in the receptacle aligned with the positioning hole into the receptacle to thereby allow the second handle part to pivot relative to the first handle part.

Preferably, the control member includes an engaging portion on an inner end thereof. The engaging portion is engaged in the retaining section of the positioning hole to prevent the control member from disengaging from the second handle part.

The retaining section of the positioning hole includes a recess and the engaging portion of the control member includes a key engaged with the recess to prevent the control member from rotating in the positioning hole.

Preferably, each positioning member includes a receptacle for receiving a portion of an associated one of the elastic elements.

Preferably, the control member includes an anti-slipping section provided on an outer end thereof.

Preferably, the outer periphery of the second handle part includes a receiving portion in a portion corresponding to the outer end of the control member for receiving a finger of a user.

Preferably, the end face of the first handle part and the end face of the second handle part are slanted.

Preferably, the end face of the first handle part and the end face of the second handle part are oval.

Preferably, the receptacles of the first pivotal coupling section are located on a longitudinal axis of the end face of the first handle part.

In an example, the first pivotal coupling portion of the first handle part is an axle and the second coupling portion of the second handle part is a groove.

In another example, the first pivotal coupling portion of the first handle part is a groove and the second coupling portion of the second handle part is an axle. The receptacles are defined in a bottom wall defining the groove.

Preferably, the positioning hole extends outward in a direction at an inclined angle with a longitudinal axis of the second handle part and has an outer end faces away from the first handle part.

Other objectives, advantages, and novel features of the invention will become more apparent from the following detailed description when taken in conjunction with the accompanying drawings.

DETAILED DESCRIPTION OF THE PREFERRED EMBODIMENTS

Figure 1:
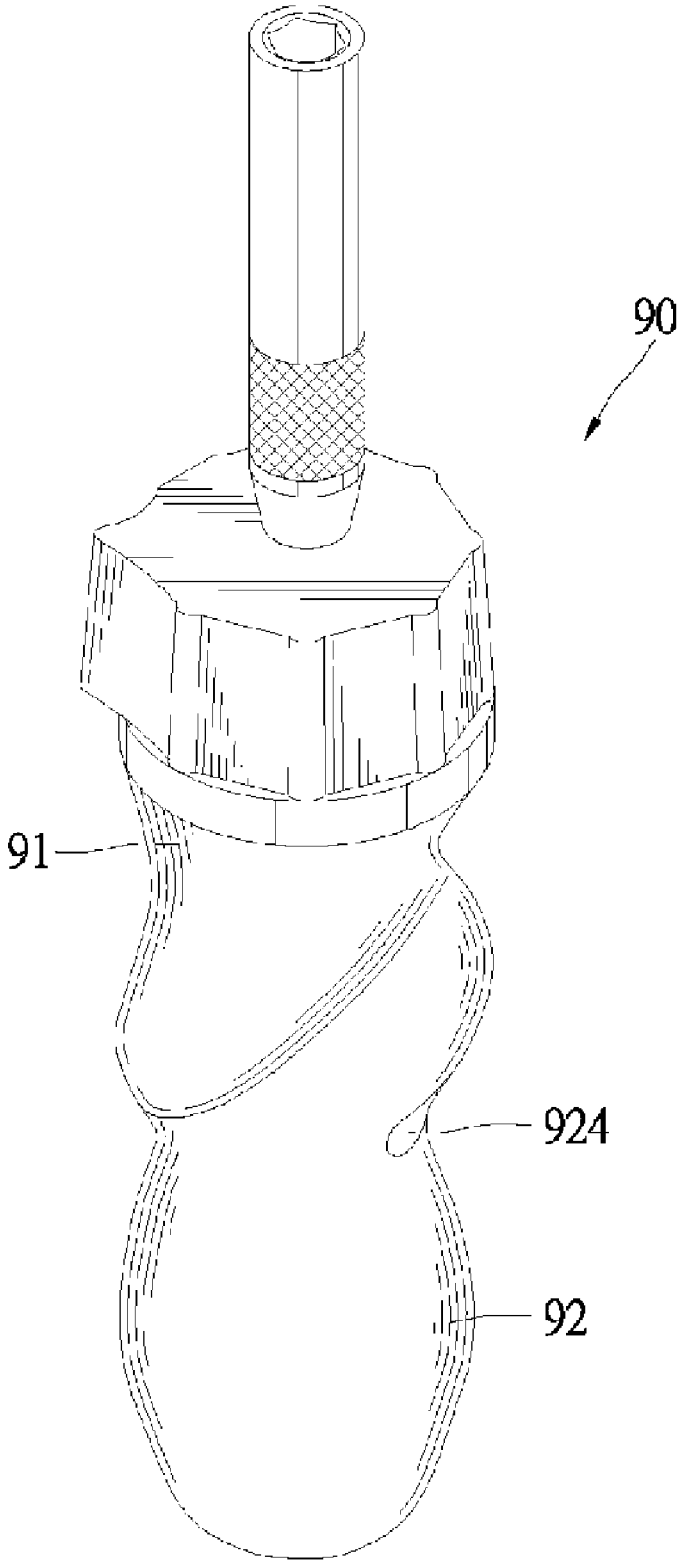
Fig. 1 PRIOR ART
FIG. 1 is a perspective view of a conventional screwdriver handle.
Figure 2:
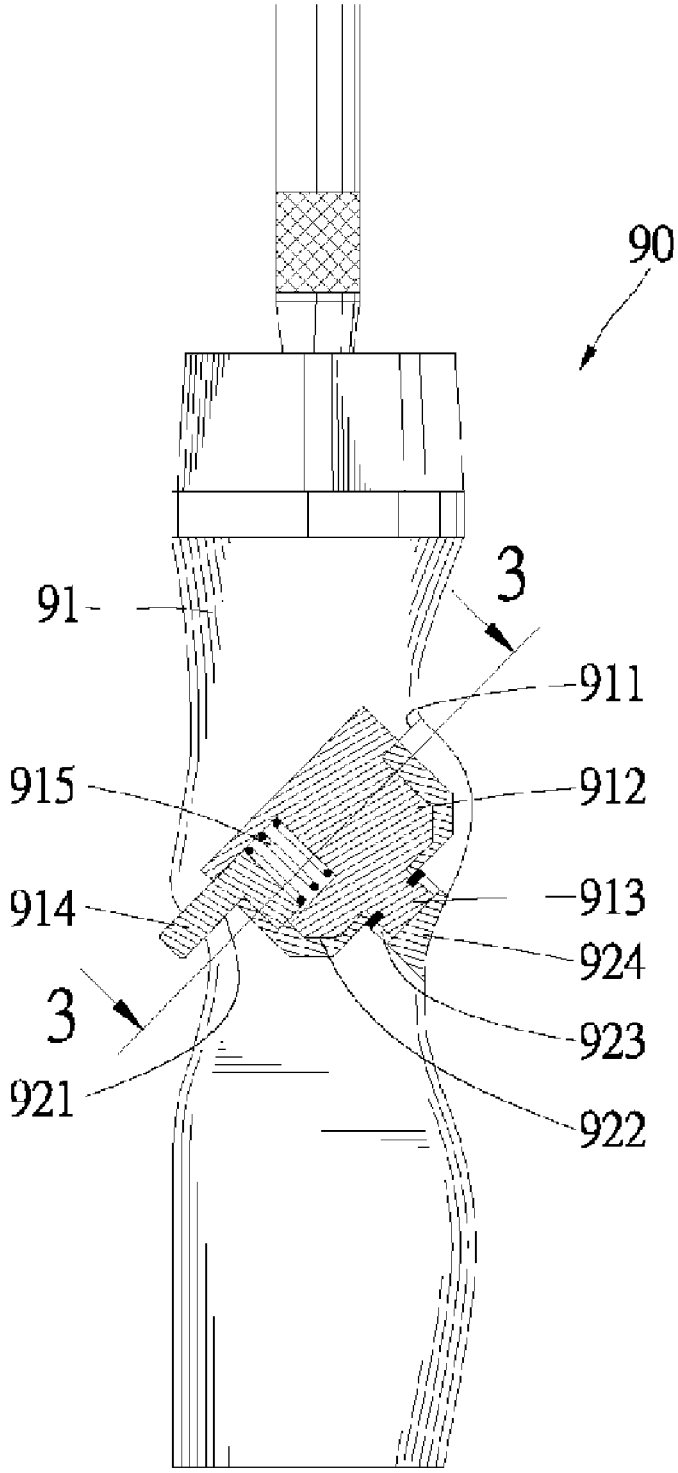
Fig. 2 PRIOR ART
FIG. 2 is a sectional view of the screwdriver handle in FIG. 1.
Figure 3:
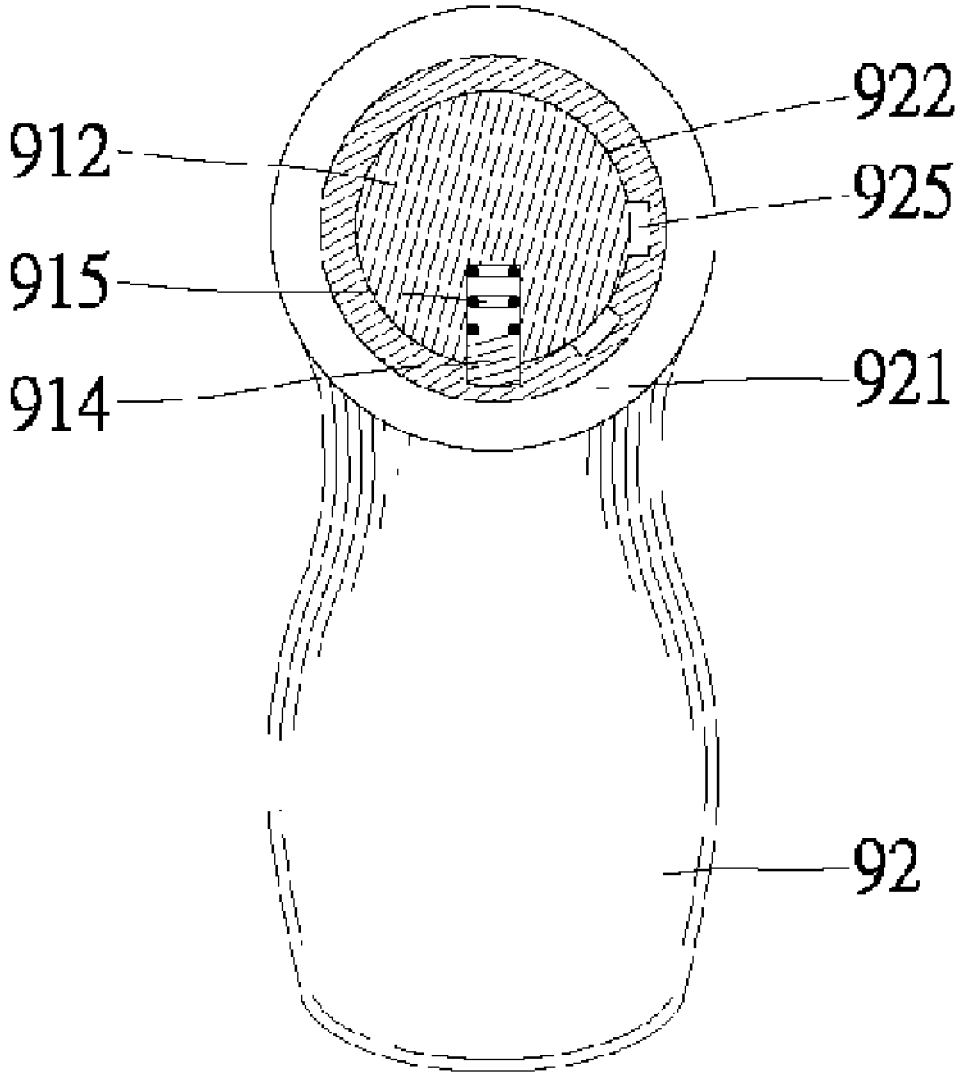
Fig. 3 PRIOR ART
FIG. 3 is a sectional view taken along plane 3-3 in FIG. 2.
Figure 4:
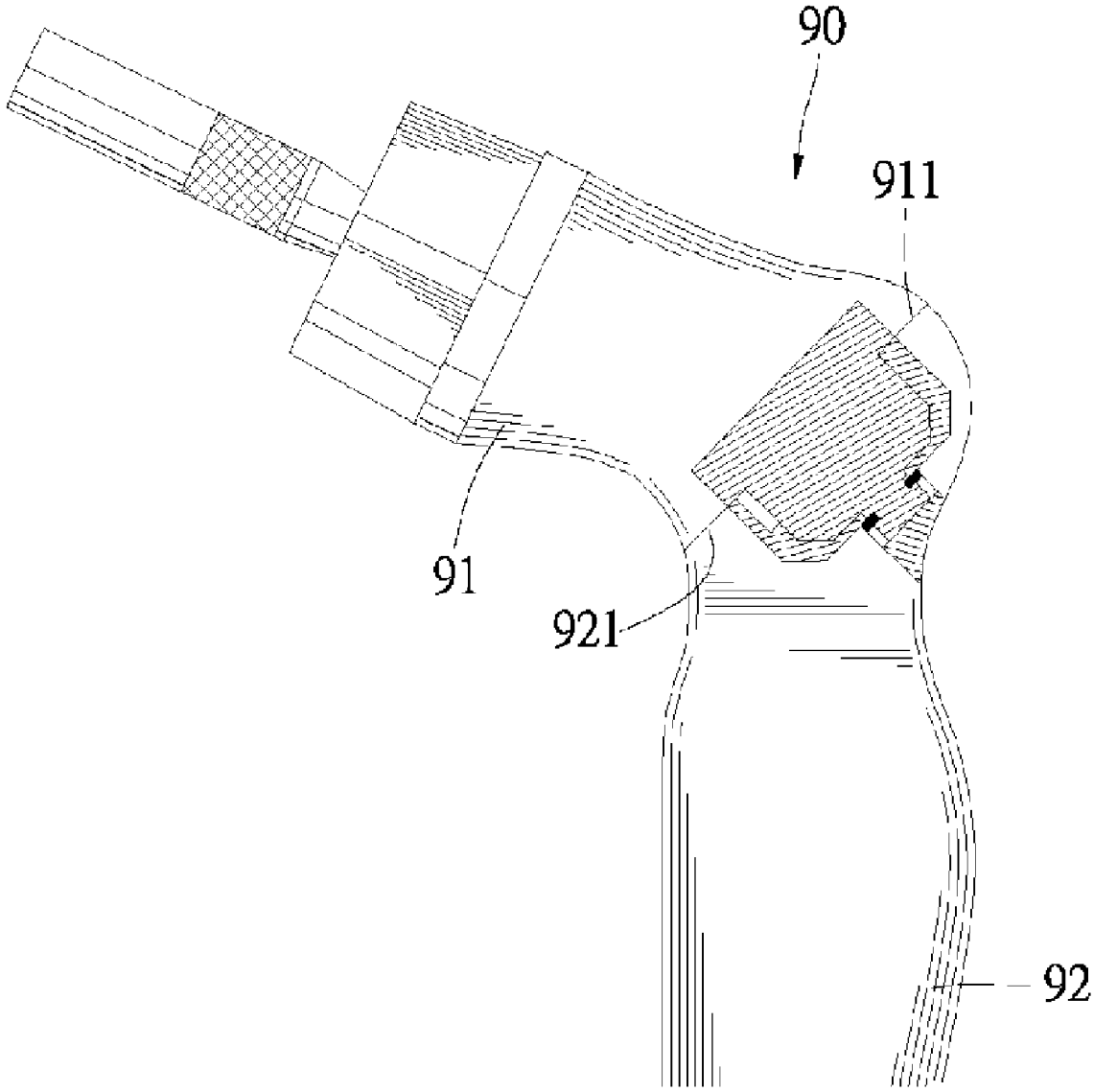
Fig. 4 PRIOR ART
FIG. 4 is another sectional view of the screwdriver handle in FIG. 1, wherein the screwdriver handle is in an angled state.
Figure 5:
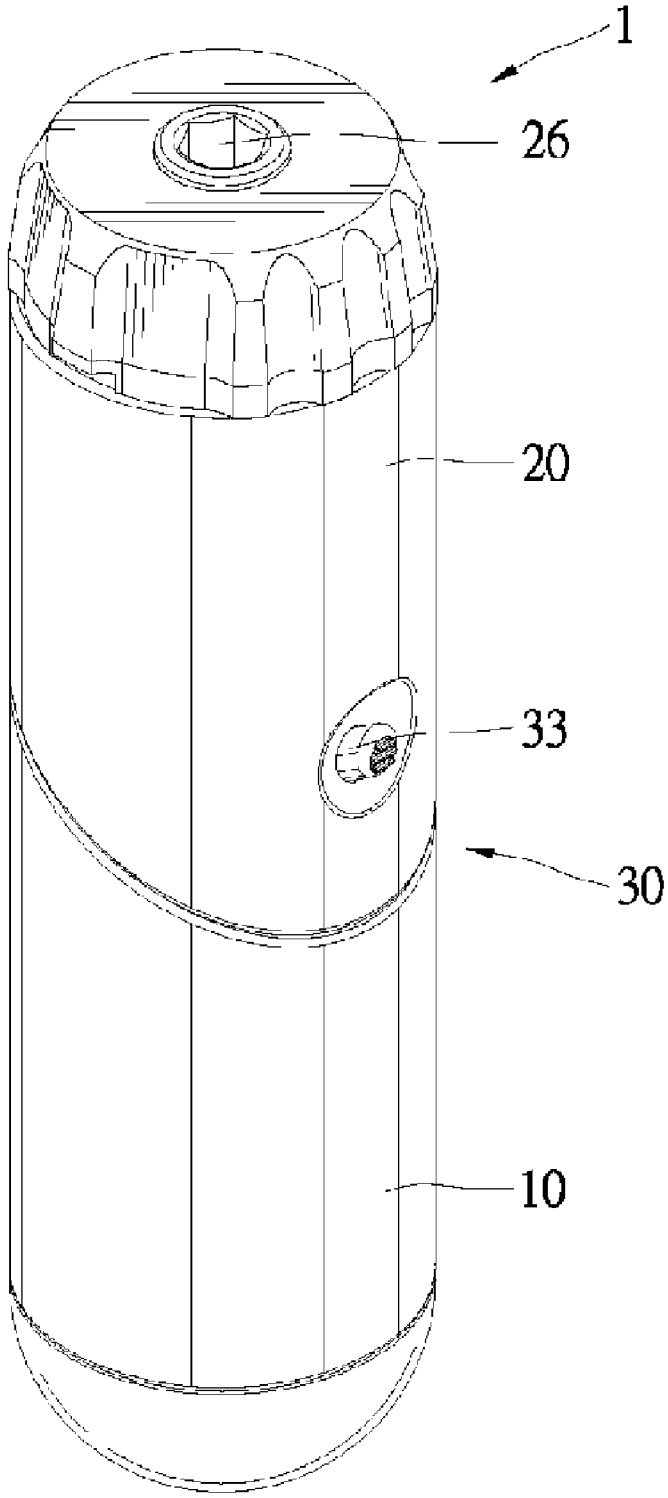
FIG. 5 is a perspective view of a screwdriver handle in accordance with the present invention.
Figure 6:
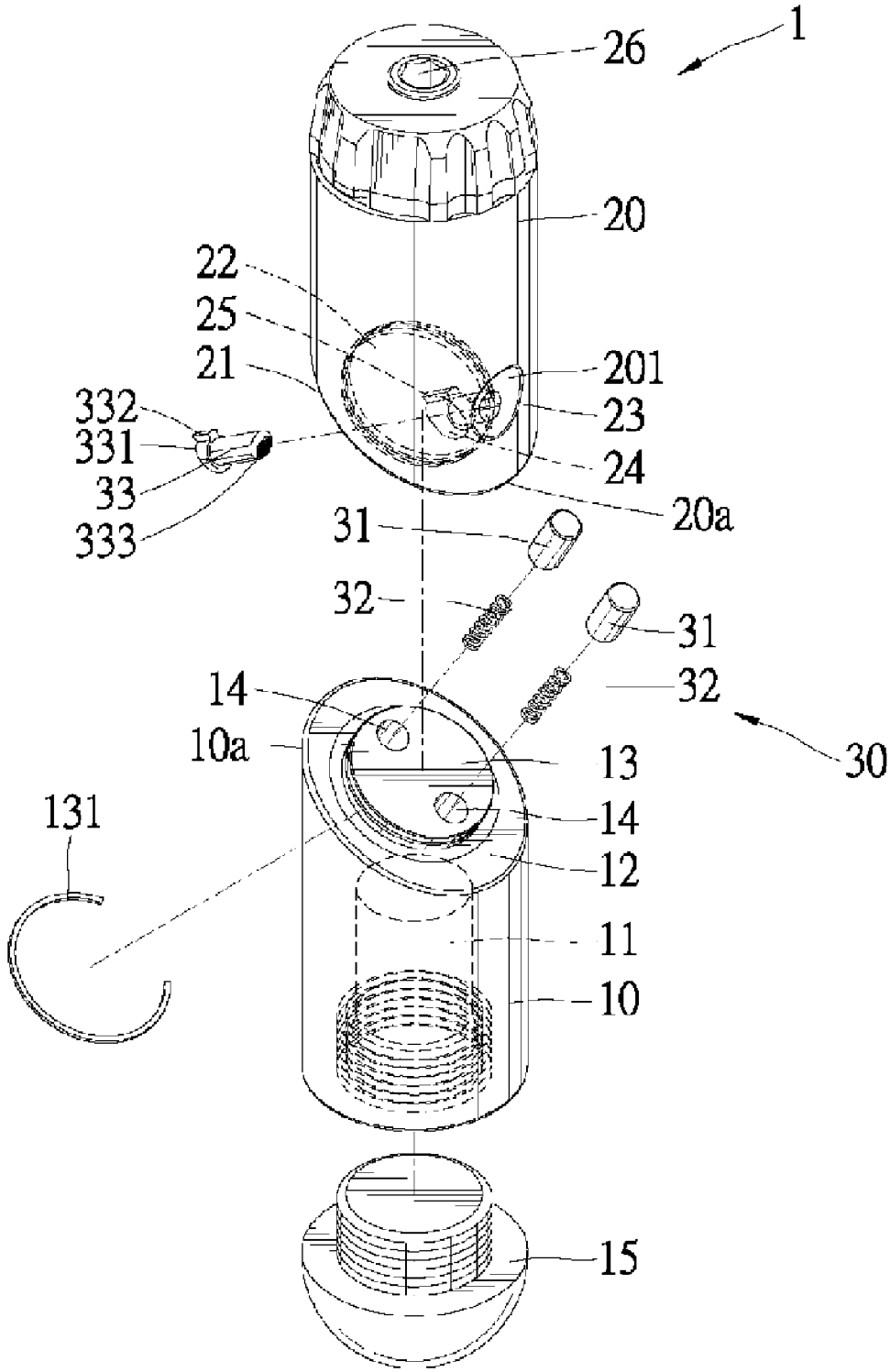
FIG. 6 is an exploded perspective view of the screwdriver handle in FIG. 5.
Figure 7:
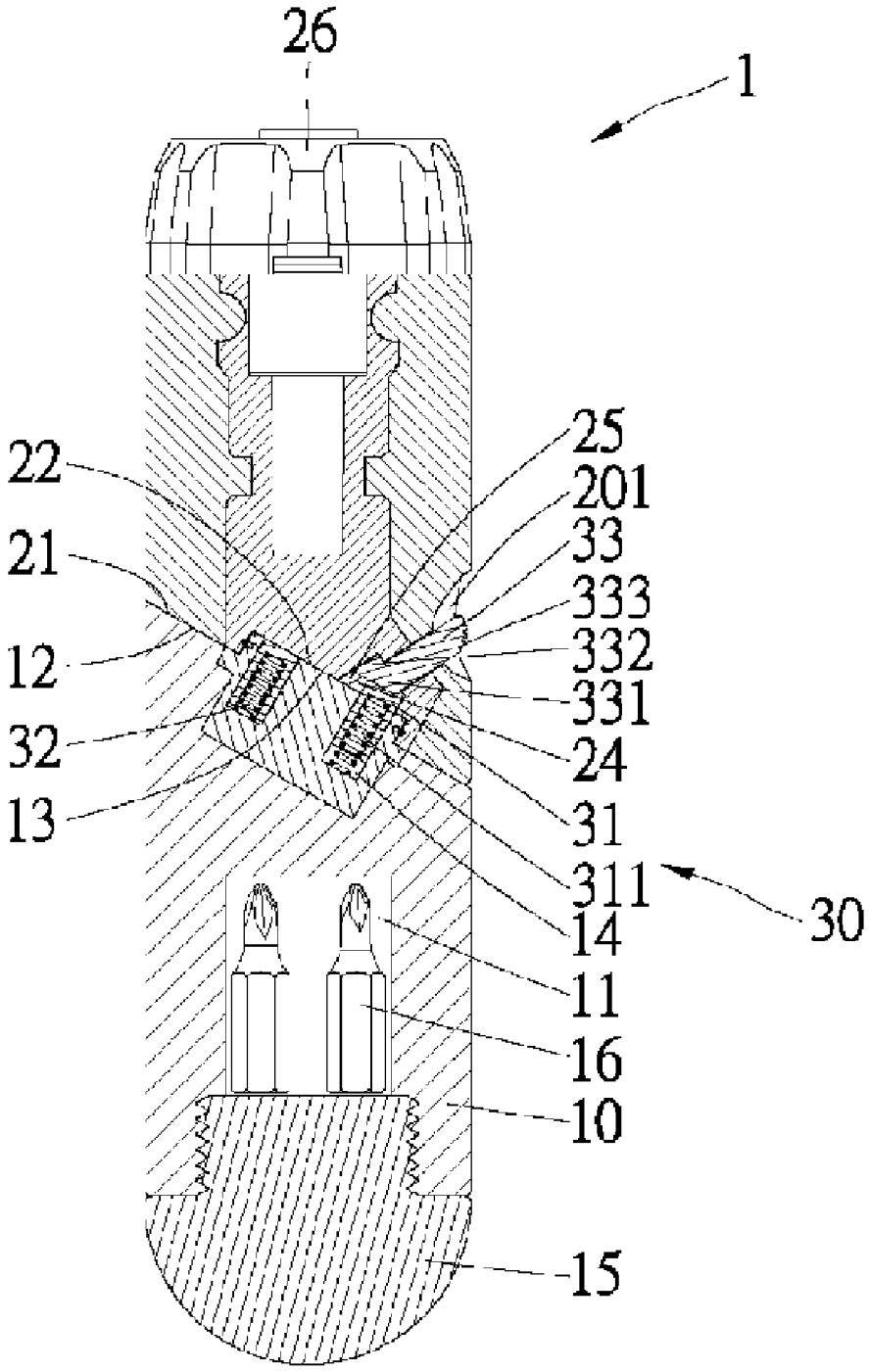
FIG. 7 is a sectional view of the screwdriver handle in accordance with the present invention.

Referring to FIGS. 5 through 7, a screwdriver handle 1 in accordance with the present invention comprises a first handle part 10, a second handle part 20, and a positioning device 30. The second handle part 20 is pivotally connected to an end of the first handle part 10 and retained in place by the positioning device 30.

The first handle part 10 includes a first end and a second end. A compartment 11 is defined in the first end of the first handle part 10 for receiving a plurality of bits 16, and an end cap 15 is provided to seal the compartment 11. The second end of the first handle part 10 includes a slanted connecting portion 10*a*. The slanted connecting portion 10*a* of the first handle part 10 includes a non-circular (oval in this example) end face 12. Preferably, the end face 12 is slanted. Namely, the end face 12 extends in a plane at an acute angle with a longitudinal axis of the first handle part 10. A pivotal coupling portion (an axle 13 in this example) is formed on the end face 12 and is preferably cylindrical. Two receptacles 14 are defined in the axle 13 and preferably adjacent to two ends of a longitudinal axis of the end face 12. Preferably, the receptacles 14 are located on the longitudinal axis of the end face 12.

The second handle part 20 includes a first end and a second end. The first end of the second handle part 20 includes a coupling portion 26 for coupling with a bit (not shown) or the like. The coupling portion 26 may include a ratchet mechanism (not shown). A connecting portion 20*a* is formed on the second end of the second handle part 20 and includes a non-circular (oval in this example) end face 21. Preferably, the end face 21 is slanted. Namely, the end face 21 extends in a plane at an acute angle with a longitudinal axis of the second handle part 20. The end face 12 of the first handle part 10 and the end face 21 of the second handle part 20 are symmetric relative to the longitudinal axis of the end face 21 of the second handle part 20 that is coincident with (or parallel to) that of the end face 12 of the first handle part 10.

A pivotal coupling portion (a cylindrical axle receiving groove 22 in this example) is formed on the end face 21 of the second handle part 20 for pivotally receiving the axle 13 of the first handle part 10, allowing relative pivotal movement between the first handle part 10 and the second handle part 20. In this example, a retainer ring 131 is partially engaged in an annular groove (not labeled) defined in a circumferential wall defining the axle receiving groove 22 and partially engaged in an annular groove (not labeled) in an outer circumferential wall of the axle 13.

Figure 9:
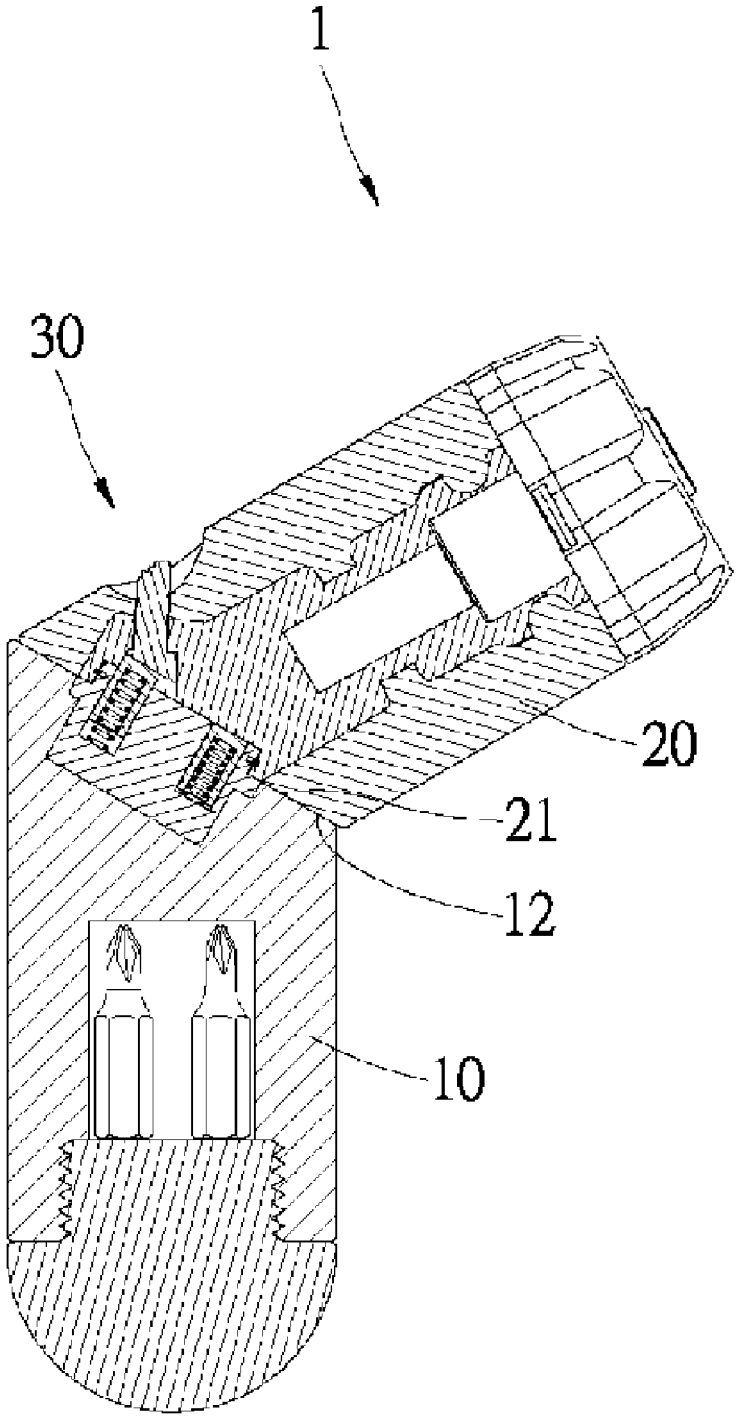
FIG. 9 is a sectional view of the screwdriver handle in FIG. 5 in an angled state.
Figure 10:
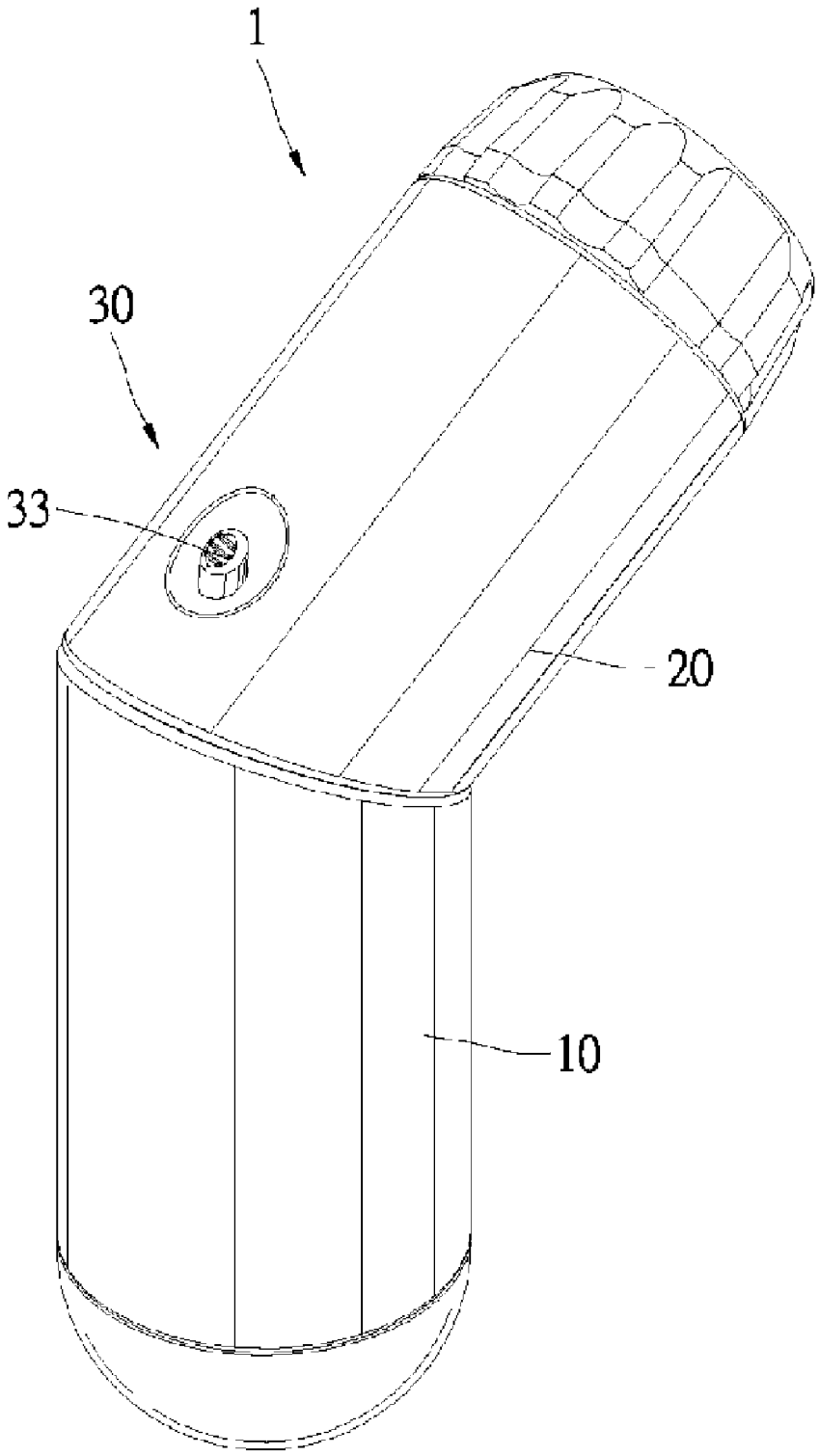
FIG. 10 is a perspective view of the screwdriver handle in FIG. 9.

The second end of the second handle part 20 is pivotally connected to the second end of the first handle part 10 and movable between a first position and a second position relative to the first handle part 10 such that the screwdriver handle 1 is switchable between an in-line operating state (see FIGS. 5 and 7) and an angled operating state (see FIGS. 9 and 10). When in the angled operating state in which the second handle part 20 is at an angle with the first handle part 10, the user may turn an object (such as a screw) with smaller force, as an arm of force is provided.

A positioning hole 23 extends from a bottom wall (not labeled) defining the axle receiving groove 22 through an outer periphery of the second handle part 20. The positioning hole 23 includes a retaining section 24 aligned with one of the receptacles 14 of the first handle part 10. The positioning section 24 includes a recess 25 in a side thereof.

The positioning device 30 includes two positioning members 31 and a control member 33. Each positioning member 31 is received in an associated receptacle 14, and an elastic element 32 is mounted between an end wall defining the receptacle 14 and the positioning member 31 for biasing the positioning member 31 outward. In this example, each positioning member 31 includes a receptacle 311 for receiving a portion of the associated elastic element 32.

The control member 33 is mounted in the positioning hole 23 of the second handle part 20 and movable in a longitudinal direction of the positioning hole 23 for controlling one of the positioning members 31 that is located in the receptacle 14 aligned with the positioning hole 23. An engaging portion 331 is provided on an inner end of the control member 33 and engaged in the retaining section 24 of the positioning hole 23, preventing the control member 33 from disengaging from the second handle part 20 via the positioning hole 23. A key 332 is formed on a side of the engaging portion 331 and engaged in the recess 25, avoiding rotational movement of the control member 33 in the positioning hole 23. An anti-slipping section 333 is provided on the outer end of the control member 33. Further, the outer periphery of the second handle part 20 includes a receiving portion 201 in a position corresponding to the outer end of the control member 33 for receiving the finger of the user that pushes the outer end of the control member 33 when desired.

Preferably, the positioning hole 23 extends outward in a direction at an inclined angle with a longitudinal axis of the second handle part (20) and has an outer end (not labeled) faces away from the first handle part 10, avoiding inadvertent pressing of the control member 33.

Referring to FIG. 7, when the second handle part 20 is in the first position (the whole screwdriver handle 1 is in the in-line state), the axes of the first handle part 10 and the second handle part 20 are coincident with each other. Further, the first handle part 10 and the second handle part 20 provide a smooth outer periphery to avoid accumulation of dust. An aesthetically pleasing appearance is provided while allowing comfortable gripping as well as easy application of force. It is noted that one of the positioning members 31 is biased by the associated elastic element 32 into the retaining section 24 to provide a reliable positioning effect for the first and second handle parts 10 and 20.

Figure 8:
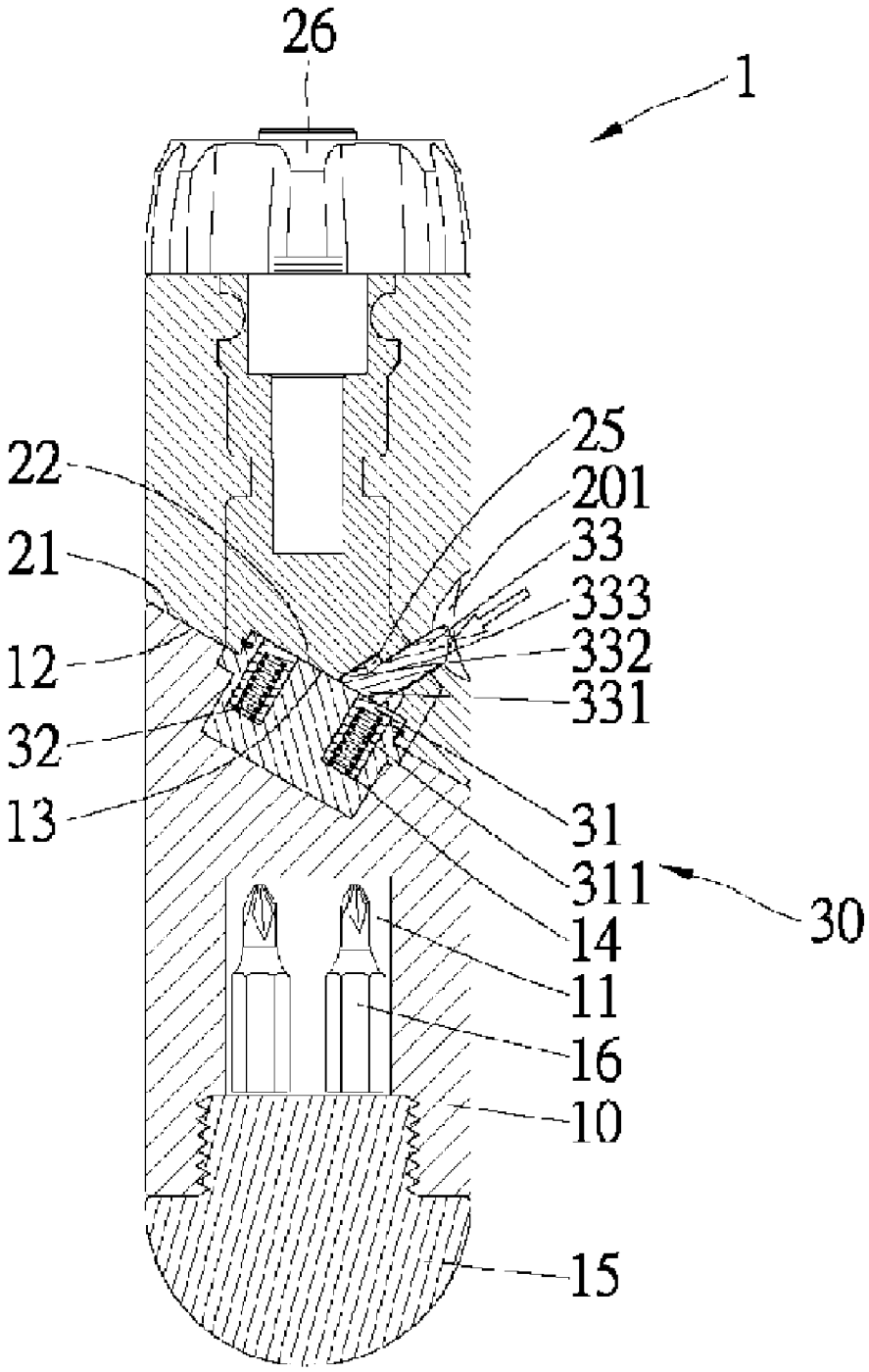
FIG. 8 is a view similar to FIG. 7, illustrating adjustment of the position of a handle part of the screwdriver handle.

Referring to FIG. 8, when the control member 33 is pushed, the engaging portion 331 of the control member 33 pushes the associated positioning member 31 into the associated receptacle 14 and compresses the associated elastic element 32. In this case, the second handle part 20 is released from the first handle part 10. The engaging portion 331 of the control member 33 abuts against the axle 13, preventing the control member 33 from entering the receptacle 14 of the axle 13.

The second handle part 20 can be pivoted 180 degrees relative to the first handle part 10 to an angled state shown in FIGS. 9 and 10. The other receptacle 14 of the first handle part 10 is now aligned with the positioning hole 23 of the second handle part 20, and the associated positioning member 31 is biased by the associated elastic element 32 into the retaining section 24 of the positioning hole 23. And the control member 33 is returned to its original position under the action of the associated elastic element 32. The screwdriver handle 1 in this state provides an arm of force to allow the user to turn a screw or the like with smaller force. Further, the screwdriver handle 1 has a smaller size and thus can be used in a smaller space.

Since the connecting portion 10*a* of the first handle part 10 and the connecting portion 20*a* of the second handle part 20 are symmetric and non-circular, a smooth outer appearance is obtained even though the screwdriver handle 1 is in the angled state. Accumulation of dust is avoided while allowing comfortable gripping as well as easy application of force.

Figure 11:
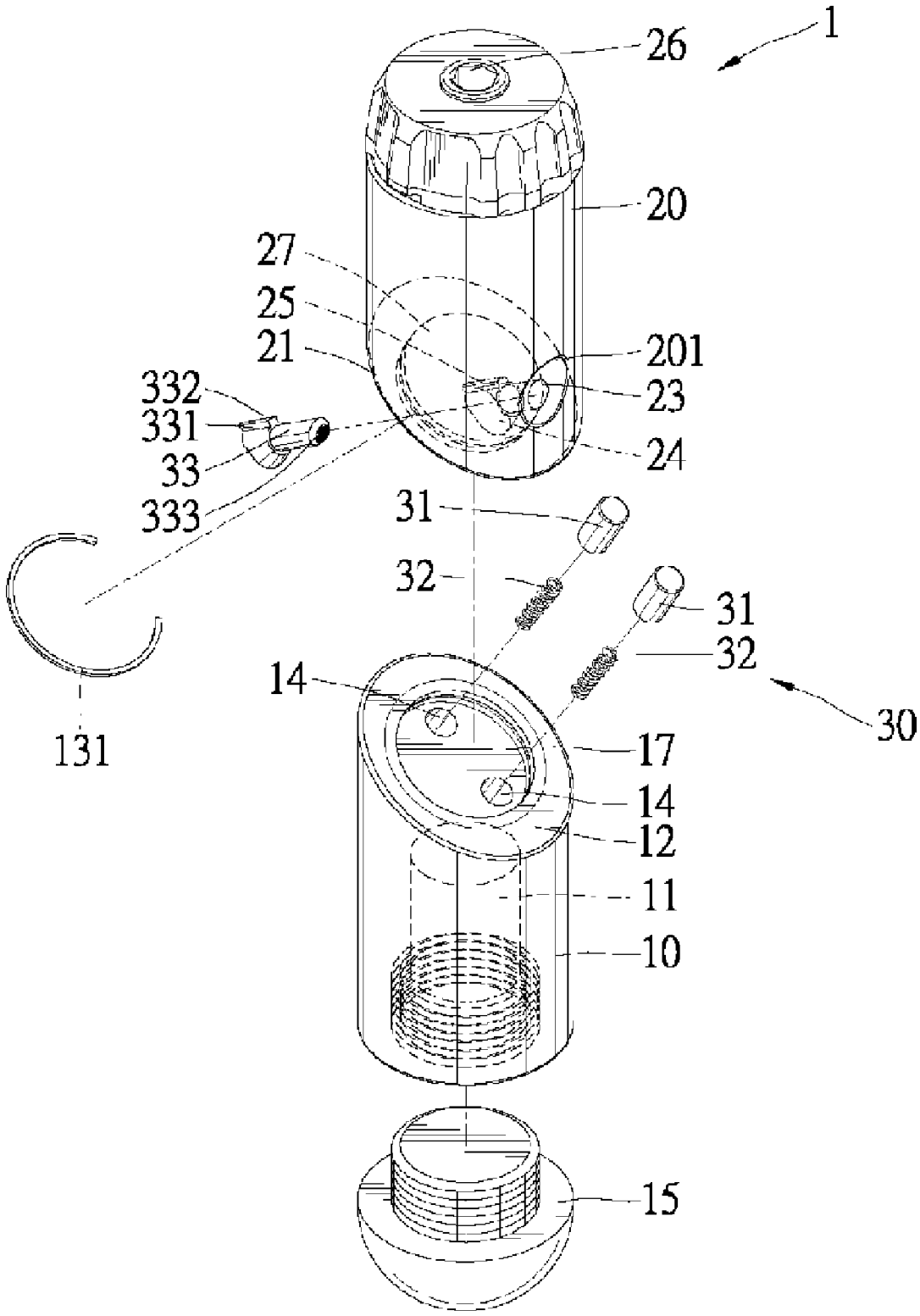
FIG. 11 is an exploded perspective view illustrating a modified embodiment of the screwdriver handle in accordance with the present invention.
Figure 12:
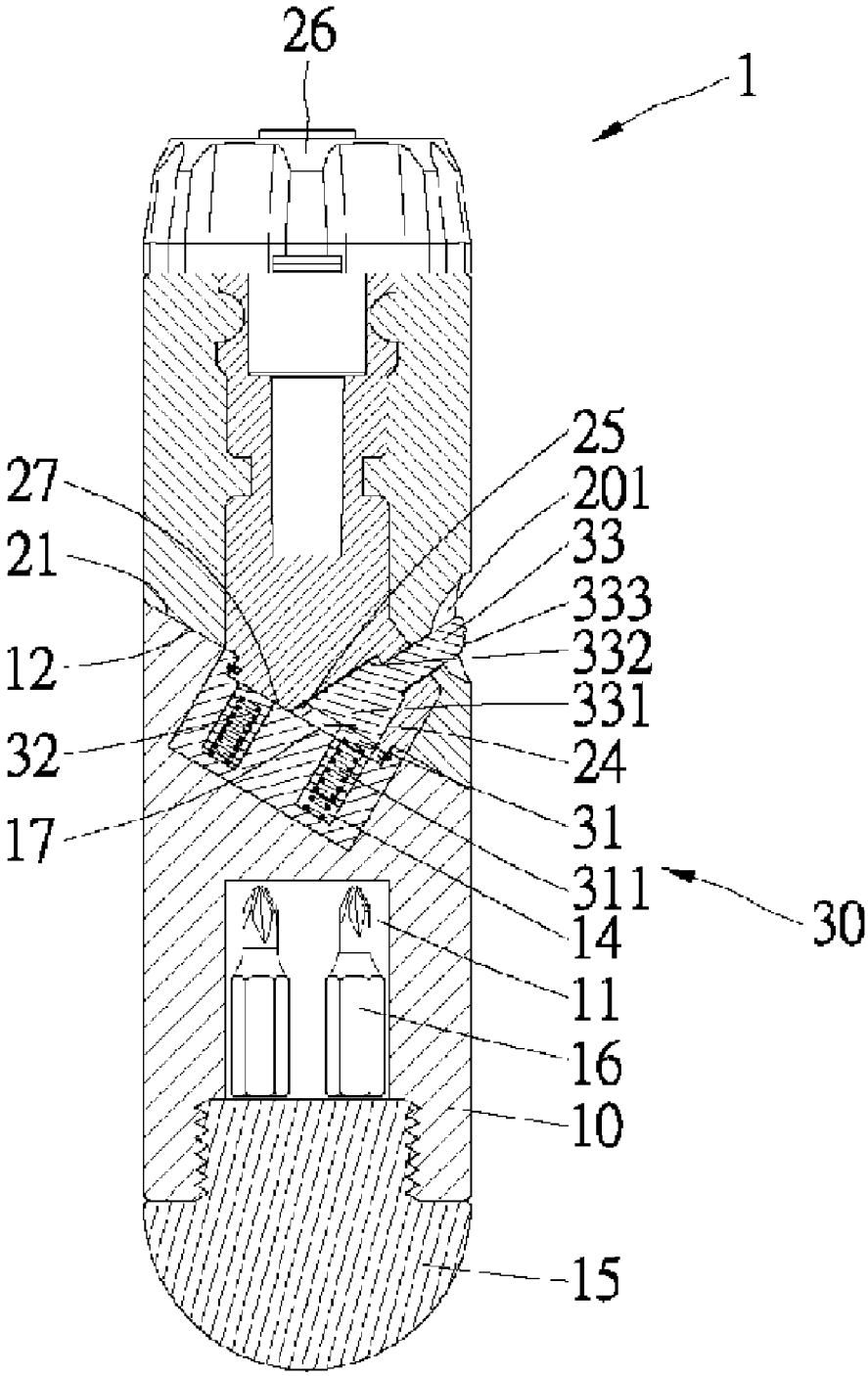
FIG. 12 is a sectional view of the screwdriver handle in FIG. 11.

FIGS. 11 and 12 illustrate a modified embodiment of the screwdriver handle 1 in accordance with the present invention. In this embodiment, the pivotal coupling portion of the first handle part 10 is a cylindrical groove 17 whereas the pivotal coupling portion of the second handle part 20 is a cylindrical axle 27 pivotably received in the cylindrical groove 17. The receptacles 14 are defined in a bottom wall defining the groove 17.

The screwdriver handle 1 in accordance with the present invention has a smaller length while allowing the handle to be switched between an in-line state and an angled operating state. Further, the user's hand will not be pinched even though the screwdriver handle is in the angled state. Further, undesired pressing of the control member 33 is less likely to occur, as the control member 33 is located on the second handle part 20 instead of the first handle part 10 that is generally gripped by the user and as the outer end of the positioning hole 23 faces away from the first handle part 10. Further, the screwdriver handle has a smooth outer periphery to allow comfortable gripping while providing an aesthetically pleasing appearance and preventing accumulation of dust. Further, only one through-hole (i.e., the positioning hole 23) is required for the screwdriver handle 1 of the type allowing switching between an in-line state and an angled state. The manufacturing cost is low and the assembling procedure is simple. Further, the oval end faces 12 and 21 of the first and second handle parts 10 and 20 provide a larger torque-bearing capacity for the screwdriver handle.

Although specific embodiments have been illustrated and described, numerous modifications and variations are still possible without departing from the essence of the invention. The scope of the invention is limited by the accompanying claims.

What is claimed is:

1. A screwdriver handle comprising:

a first handle part including an end face, a first pivotal coupling portion being formed on the end face of the first handle part; and a second handle part including an end face pivotally connected to the end face of the first handle part, the end face of the second handle part including a second pivotal coupling portion for pivotally engaging with the first pivotal coupling portion of the first handle part, the second handle part being pivotable between a first position and a second position relative to the first handle part such that the screwdriver handle is switchable between an in-line state and an angled state;

two receptacles being defined in the first pivotal coupling portion;

two positioning members being respectively received in the receptacles;

two elastic elements being respectively mounted in the receptacles for respectively biasing the positioning members outward;

a positioning hole extending from a wall of the second pivotal coupling portion through an outer periphery of the second handle part, the positioning hole including a retaining section aligned with one of the receptacles;

one of the positioning members being biased by an associated one of the elastic elements into the retaining section of the positioning hole to retain the second handle part in one of the first position and the second position; and a control member being mounted in the positioning hole and movable to urge the positioning member in the receptacle aligned with the positioning hole into the receptacle to thereby allow the second handle part to pivot relative to the first handle part.

2. The screwdriver handle as claimed in claim 1 wherein the control member includes an engaging portion on an inner end thereof and wherein the engaging portion is engaged in the retaining section of the positioning hole to prevent the control member from disengaging from the second handle part.

3. The screwdriver handle as claimed in claim 2 wherein the retaining section of the positioning hole includes a recess and wherein the engaging portion of the control member includes a key engaged with the recess to prevent the control member from rotating in the positioning hole.

4. The screwdriver handle as claimed in claim 1 wherein each said positioning member includes a receptacle for receiving a portion of an associated one of the elastic elements.

5. The screwdriver handle as claimed in claim 1 wherein the control member includes an anti-slipping section provided on an outer end thereof.

6. The screwdriver handle as claimed in claim 5 wherein the outer periphery of the second handle part includes a receiving portion in a portion corresponding to the outer end of the control member for receiving a finger of a user.

7. The screwdriver handle as claimed in claim 1 wherein the end face of the first handle part and the end face of the second handle part are slanted.

8. The screwdriver handle as claimed in claim 7 wherein the end face of the first handle part and the end face of the second handle part are oval.

9. The screwdriver handle as claimed in claim 8 wherein the receptacles of the first pivotal coupling section are located on a longitudinal axis of the end face of the first handle part.

10. The screwdriver handle as claimed in claim 1 wherein the receptacles of the first pivotal coupling section are located on a longitudinal axis of the end face of the first handle part.

11. The screwdriver handle as claimed in claim 1 wherein the first pivotal coupling portion of the first handle part is an axle and the second coupling portion of the second handle part is a groove.

12. The screwdriver handle as claimed in claim 1 wherein the first pivotal coupling portion of the first handle part is a groove and the second coupling portion of the second handle part is an axle.

13. The screwdriver handle as claimed in claim 12 wherein the receptacles are defined in a bottom wall defining the groove.

14. The screwdriver handle as claimed in claim 1 wherein the positioning hole extends outward in a direction at an inclined angle with a longitudinal axis of the second handle part and wherein the positioning hole has an outer end faces away from the first handle part.

* * * * *